US006059138A

United States Patent [19]

Labruyere

[11] Patent Number: 6,059,138

[45] Date of Patent: May 9, 2000

[54] SLOTTED CUP HOLDER

[76] Inventor: Andre Labruyere, 4125 Mcgee, Kansas City, Mo. 64111

[21] Appl. No.: 09/286,651

[22] Filed: Apr. 6, 1999

Related U.S. Application Data

[60] Provisional application No. 60/081,019, Apr. 8, 1998.

[51] Int. Cl.[7] ..... A47G 19/06; A47G 19/22

[52] U.S. Cl. ..... 220/574; 220/23.4; 220/23.86; 220/23.87; 220/737

[58] Field of Search ..... 220/574, 23.4, 220/23.83, 23.86, 23.87, 737, 738, 759, 23.2, 23.6, 23.89, 575; 206/426

[56] References Cited

U.S. PATENT DOCUMENTS

| | | | |
|---|---|---|---|
| 4,606,523 | 8/1986 | Statz et al. | 220/737 |
| 4,607,758 | 8/1986 | Stevens | 220/23.83 |
| 4,726,553 | 2/1988 | Wischusen, III . | |
| 4,852,843 | 8/1989 | Chandler | 220/737 |
| 4,960,225 | 10/1990 | Gillis | 220/737 |
| 4,961,555 | 10/1990 | Egan et al. | 220/23.83 |
| 5,029,720 | 7/1991 | Bridges | 220/737 |
| 5,110,170 | 5/1992 | Boatwright | 220/23.83 |
| 5,207,076 | 5/1993 | Sciarrillo . | |
| 5,209,367 | 5/1993 | Van Musscher et al. . | |
| 5,238,161 | 8/1993 | Kimishima . | |
| 5,285,953 | 2/1994 | Smith | 220/737 |
| 5,361,932 | 11/1994 | Friedrich . | |
| 5,397,089 | 3/1995 | Katoaka . | |
| 5,419,455 | 5/1995 | Russeau | 220/23.83 |
| 5,447,764 | 9/1995 | Langford . | |
| 5,492,246 | 2/1996 | Bailey | 220/756 |

*Primary Examiner*—Stephen Castellano
*Assistant Examiner*—Niki M. Eloshway
*Attorney, Agent, or Firm*—Richard C. Litman

[57] ABSTRACT

The present invention provides a slotted cup holder having multiple slots that is adapted to accommodate a variety of beverage container shapes. The cup holder comprises a cylindrical body having two elongated lateral slots for a cup handle, a semi-circular top anterior slot, a large horizontal bottom anterior slot disposed at the front base of the cylindrical body, and an integrally formed elongated flat appendage that extends outward from the rear base of the cylindrical body. The elongated flat appendage serves to secure the cup holder to an appropriately configured table by sliding the appendage between a table rail and the table. The present invention is designed to accommodate not only traditional non-handled cups, but also handled cups, as well as short and long stem wine glasses. The economy of design of the present invention makes the slotted cup holder both practical and inexpensive.

5 Claims, 6 Drawing Sheets

SLOTTED CUP HOLDER

CROSS-REFERENCE TO RELATED APPLICATION

This application claims the benefit of U.S. Provisional patent application Ser. No. 60/081,019, filed Apr. 8, 1998.

BACKGROUND OF THE INVENTION

1. Field of the Invention

The present invention relates to beverage receptacles and, particularly, to a slotted beverage receptacle that can accommodate a variety of beverage container shapes.

2. Description of Related Art

The entertainment industry constitutes one of the largest money making industries in the world. Legalized gambling is a major component of the entertainment industry attracting millions of people each year to various locations throughout the world. For instance, Las Vegas, Nev. and Atlantic City, N.J. attract as many tourist each year as Walt Disney World.

Black Jack tables are a mainstay of casinos offering exciting and stimulating entertainment that is mixture of chance and skill. Frequently, the customer wishes to enjoy his or her favorite beverage while playing Black Jack or some other game of chance. However, often beverage containers are not suited to be enjoyed while someone is playing cards. The havoc caused by spilling a beverage onto a table on which a game of chance is being played is obvious, producing a high level of anxiety in both the customer and the employees of the establishment.

The gambling tables in a casino are equipped with a table rail that serves to keep the implements of a particular game confined to the table. The table rail also functions as an armrest for the customer as he or she plays the game. Furthermore, the table rail is used to secure drinks in cup holders by placing an integrally formed elongated appendage of the cup holder between the table rail and the table.

The cup holders traditionally used in casinos are designed to accommodate cups that do not have handles, typically, disposable beer cups. Thus, conventional casino cup holders are not adapted for use with beverage containers that have a handle or whose shape is drastically different from that of the traditional handleless cup.

The present invention is designed to accommodate not only traditional non-handled cups but handled cups, and short and long stem wine glasses as well. The prior art describes a variety of cup holders, however, none of the prior art cup holders possess the unique features and characteristics of the slotted cup holder of the present invention.

A drinking cup base that can be used as either a coaster or an attached stabilizer and that can be used with a variety of cups is described in U.S. Pat. No. 4,726,552 issued on Feb. 23, 1988 to H. Wischusen, III. The drinking cup base has a spill tray to collect any spills that may occur from the cup. The drinking cup base has a recess that is configured for accepting the lower portion of an upright drinking cup which maintains the cup in an upright position, and an annular rim that is disposed about the mouth of the recess for continuous contact about the outer surface of the cup such that a vacuum is formed in the recess that maintains the cup within the base.

U.S. Pat. No. 5,207,076 issued on May 4, 1993 to G. Sciarrillo describes a pitcher cooler for cooling liquid held in a vessel having an externally extending handle. The pitcher cooler consists of a double-walled container that has an inner wall and an outer wall that are radially spaced apart. A refrigerant coolant for maintaining the container at a predetermined cool temperature for a specific time interval is disposed in the closed space between the inner and outer walls. The pitcher cooler contains a slot through which the handle of the vessel extends.

A sleeve for a beverage container such as a can or bottle that is adapted to be slipped onto the container so that there is a tight fit is described in U.S. Pat. No. 5,209,367 issued on May 11, 1993 to R. F. Van Musscher et al. The sleeve prevents both heat losses or heat gains by insulating the container from unwanted heat transfer to or from the container. The sleeve consists of a flat piece of sheet material having sufficient area to cover a substantial portion of the sides of the container.

The sheet material has a joint at each longitudinal edge. The joints are used to form the sleeve into a cylinder with the location of the joints determining the diameter of the cylindrical sleeve. The joints secure the ends of the cylinder so that the sleeve can be push-fit on the container to which it is fitted.

U.S. Pat. No. 5,397,089 issued on Mar. 14, 1995 to J. Kataoka describes a glass holder that is used to hold a glass stably at the edge of a dish. The holder has a glass holding body shaped like a cup and a cylindrical mounting frame that vertically extends from the underside of the bottom of the glass holding body. The mounting frame is cut horizontally halfway around to form a mounting section where the edge of a dish can be freely inserted into or removed from the mounting section. The bottom of the glass holding body has an opening that forms a leg holding section for receiving the leg of a legged glass.

None of the above inventions and patents, taken either singly or in combination, is seen to describe the instant invention as claimed. The economy of design of the present invention makes the slotted cup holder both practical and inexpensive. The present invention satisfies the need of providing a cup holder that is multi-faceted in its functionality.

SUMMARY OF THE INVENTION

Accordingly, it is a principal object of the invention to provide a slotted cup holder that with accommodate a multitude of beverage container shapes.

It is another object of the invention to provide a slotted cup holder that is functional and convenient to use.

It is a further object of the invention to provide a slotted cup holder that is used at a casino table without concern of beverage spillage.

Still another object of the invention is to provide a slotted cup holder that is both readily secured to a casino table and easily removable from a casino table.

It is an object of the invention to provide improved elements and arrangements thereof in a slotted cup holder for the purposes described which is inexpensive, dependable and fully effective in accomplishing its intended purposes.

To meet the above objectives, the present invention provides a slotted cup holder having multiple slots that is adapted to accommodate a variety of beverage container shapes. The cup holder comprises a cylindrical body having two elongated lateral slots for a cup handle, a semi-circular top anterior slot, a large horizontal bottom anterior slot disposed at the front base of the cylindrical body, and an integrally formed elongated flat appendage that extends outward from the rear base of the cylindrical body. The integrally formed elongated flat appendage is used to secure the cup holder to an appropriately configured table, for example, a casino table that has a table rail.

The semi-circular top anterior slot and the horizontal bottom anterior slot are used to hold a stemmed beverage container, for example, a wine glass. In a preferred embodiment, the cup holder has an elongated anterior indentation that extends from the top anterior slot to the bottom anterior slot of the cup holder. The elongated indentation serves to secure the stem of a wine glass, thereby increasing the stability of the wine glass held by the cup holder.

The present invention takes into account the handedness of the individual using the cup, that is, whether or not the person is right-handed or left-handed, by the providing the user with two slots that are disposed 90 degrees to one another. Thus, the user places the handle of the cup in the slot that is most comfortable for him or her.

In alternate embodiments, the top portion of the two elongated lateral slots is either tapered or flared. The tapering or the flaring of the top portion of the elongated lateral slot facilitates the insertion and the removal of the cup handle.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
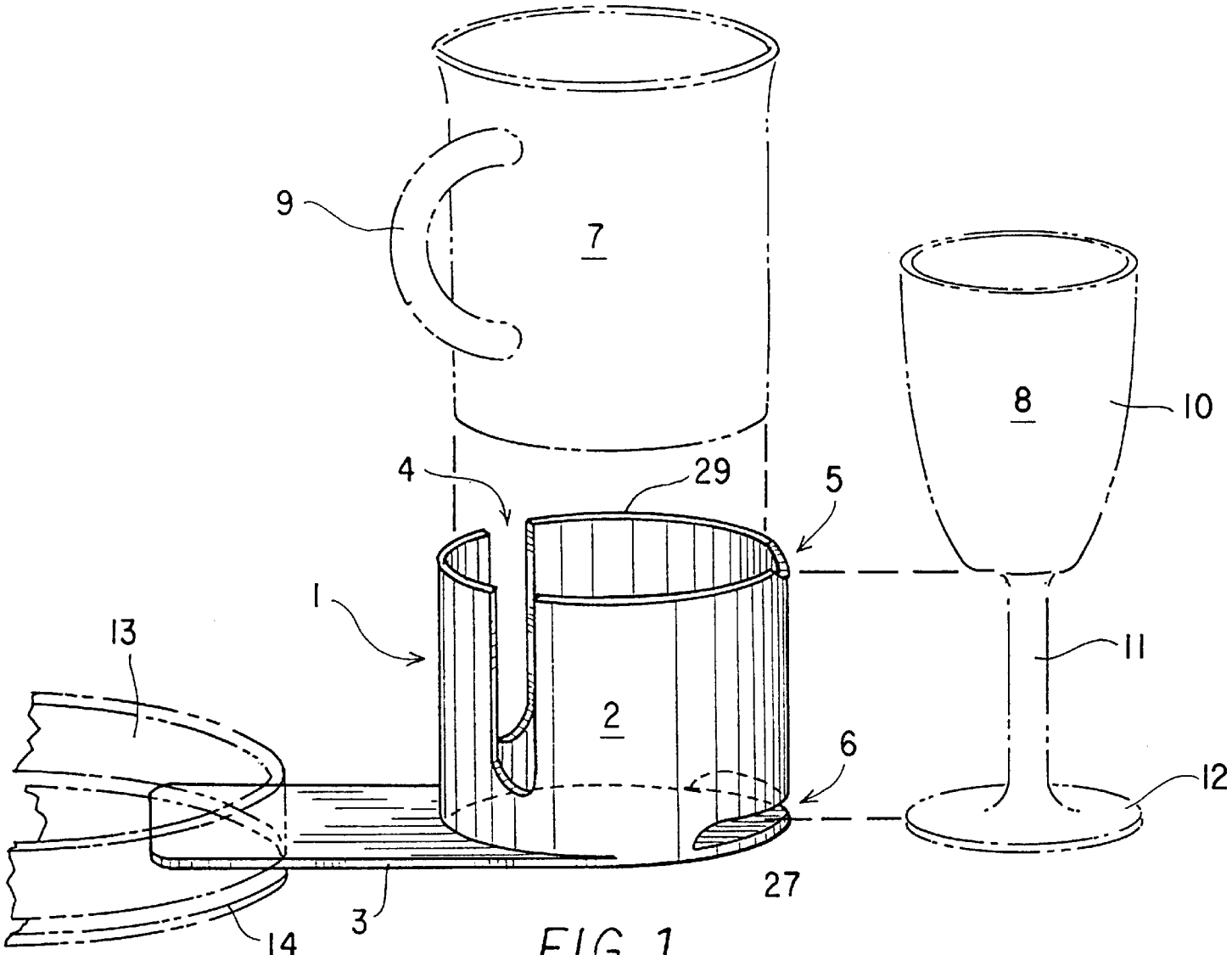
FIG. 1 is an environmental, perspective view of a slotted cup holder according to the present invention showing the slotted cup holder secured to a table having a table rail using the elongated, flat integrally formed appendage of the holder.

The present invention is described with reference to FIGS. 1–7. FIG. 1 shows an environmental, perspective view of a slotted cup holder 1 according the present invention comprising a hollow cylindrical body 2 and an integrally formed elongated flat appendage 3 that extends outward from the rear base of the cylindrical body 2. The height and the width of the cylindrical body 2 are approximately 2⅞" and 3⅜" respectively. The total length of the cup holder 1, including the length of the elongated flat appendage 3, is approximately 5½". The wall thickness of the cylindrical body 2 (cup) is approximately ⅛", the inner diameter of the cylindrical body 2 is approximately 3⅜", and the elongated flat appendage 3 (tongue) has a thickness of approximately 1/16".

The hollow cylindrical body 2 of the cup holder 1 has two elongated laterally disposed slots 4 of approximately ½" width. The two elongated lateral slots 4 are disposed 90 degrees to one another with each elongated slot disposed 45 degrees from the midline that dissects the cup holder 1 into two equal halves. The cylindrical body 2 also has an upper anterior slot 5 that is semi-circular and lower anterior slot 6 that has a horizontal oblong contour. The cylindrical body 2 has an open top portion 29 and a base portion 27. The lateral slots 4 extend vertically from the open top portion 29 to proximate the base portion 27.

As shown in FIG. 1, the elongated lateral slots 4 are made to accommodate the handle 9 of a cup 7 while the top front semi-circular slot 5 and the bottom front oblong horizontal slot 6 are made to accommodate either a short or long stem 11 of a wine glass 8. The front semi-circular upper slot 5 receives the receptacle portion 10 of the wine glass 8 while the front oblong horizontal lower slot 6 receives the base 12 of the wine glass 8 with the base 12 of the wine glass 8 fitting snugly in place. The stem 11 of the wine glass 8 rests flush against the anterior surface of the cup 2.

In a first preferred embodiment, the cup 2 has an elongated indentation (not shown) that extends from the semi-circular upper slot 5 to the oblong horizontal lower slot 6. The elongated indentation receives the stem 11 of the wine glass 8, further ensuring that the wine glass 8 is held securely in place.

Figure 2:
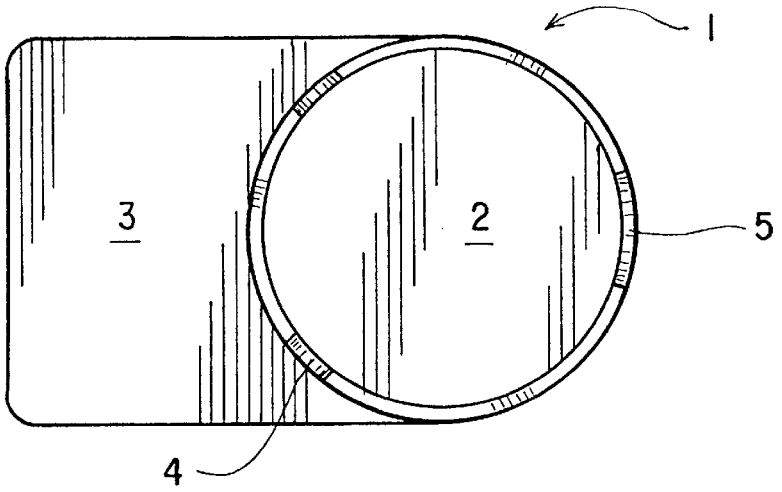
FIG. 2 is a top view of the slotted cup holder according to the present invention showing the spatial relationship between the two lateral slots and the upper front slot of the cup holder.
Figure 3B:
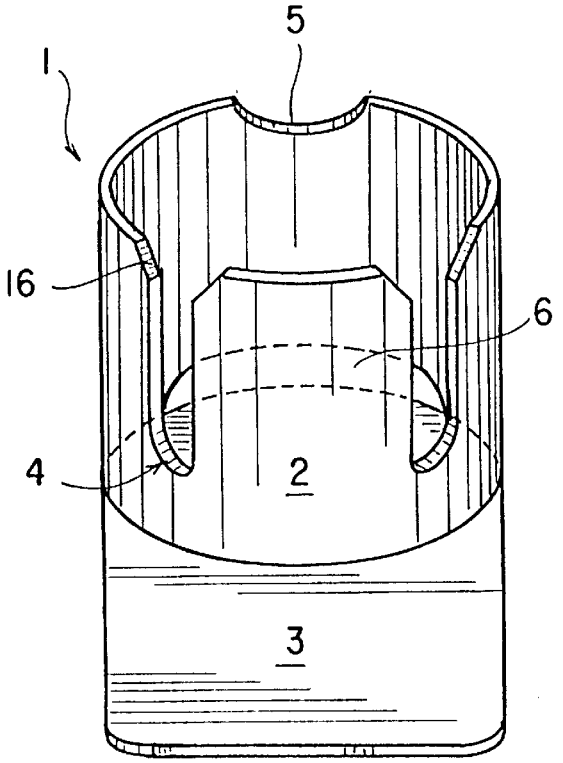
FIG. 3B is a rear, perspective view of a second alternate embodiment of the slotted cup holder according to the present invention showing the top portion of the two lateral slots tapered.
Figure 3A:
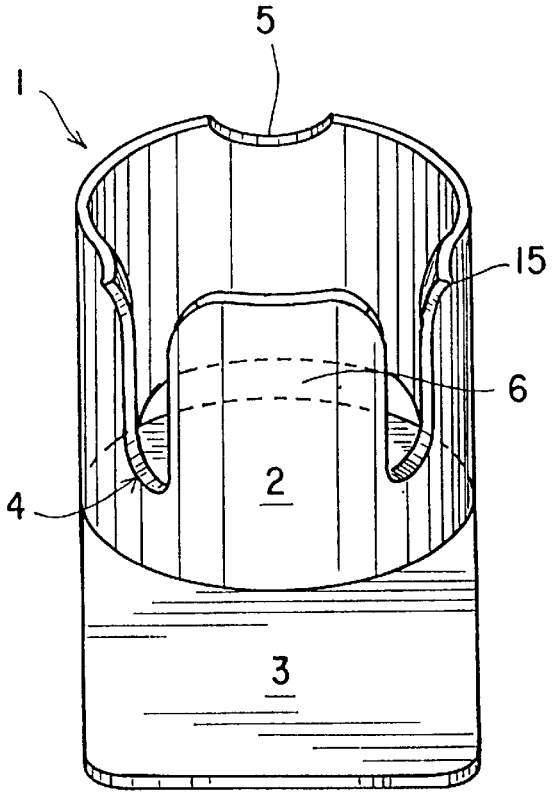
FIG. 3A is a rear, perspective view of an alternate embodiment of the slotted cup holder according to the present invention showing the top portion of the two lateral slots flared.

FIG. 2 is a top view of the cup holder 1 showing the spatial relationship between the two elongated lateral slots 4 and the upper semi-circular front slot 5. FIGS. 3A and 3B are rear, perspective views of alternate embodiments of the present invention. In FIG. 3A, the upper portion 15 of the elongated lateral slots 4 is flared while in FIG. 3B, the upper portion 16 of the elongated lateral slots 4 is tapered. Both the tapering and the flaring of the upper portion of the elongated lateral slots 4 facilitate the insertion and removal of the cup handle 9. It should be understood by those skilled in the art that various modifications and adaptations as well as alternative embodiments may be contemplated.

Figure 4:
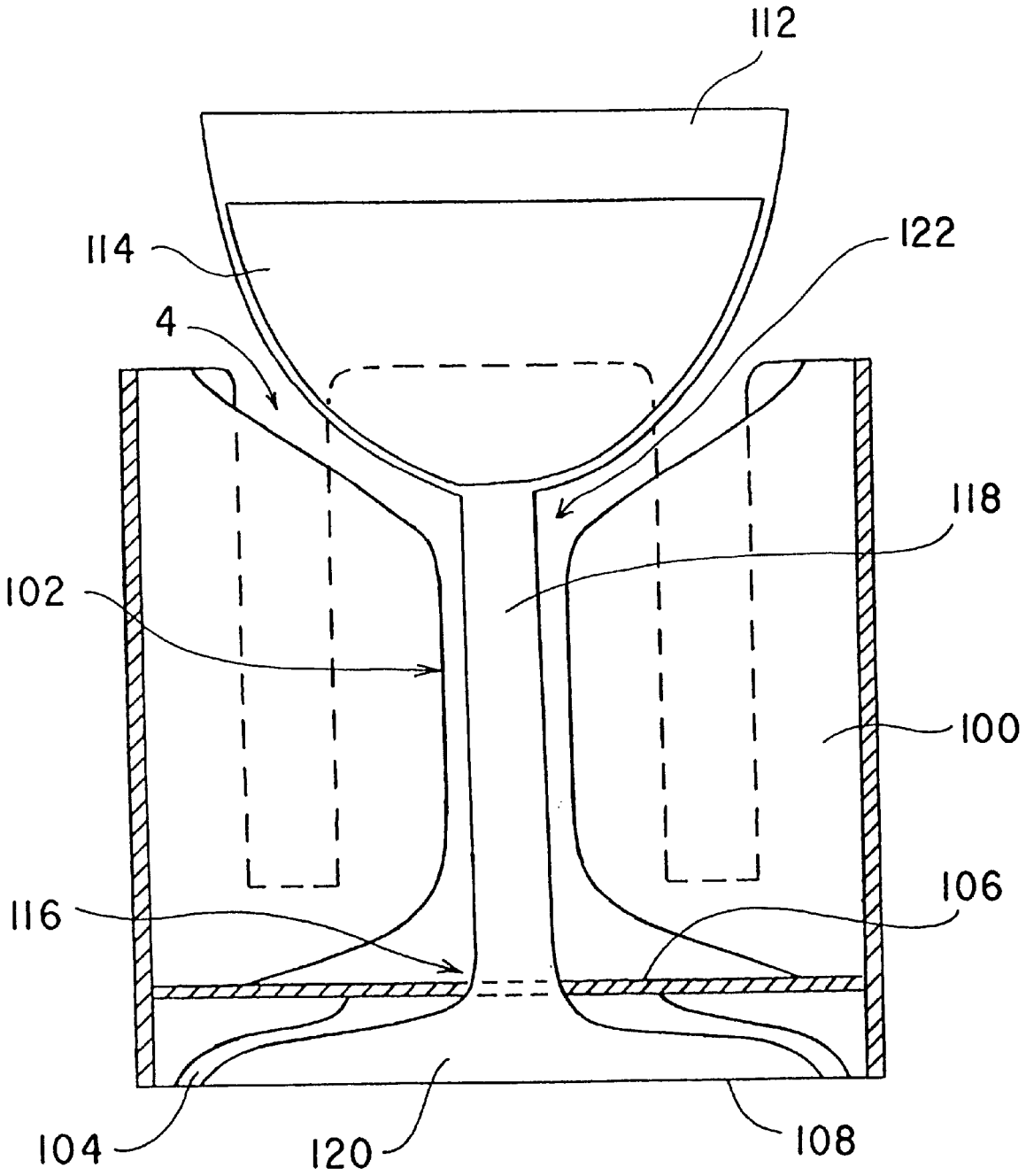
FIG. 4 is a front view of a preferred embodiment of a slotted cup holder showing the anterior slot, and the upper and lower compartments according to the present invention.

FIG. 4 shows a front view of a second preferred embodiment of the slotted cup holder 100 of the present invention. The anterior slot 102 of this embodiment divides the anterior portion of the cup 100 into two halves and makes the upper compartment 122 of the cup holder 100 readily accessible to a stemmed beverage glass 112 containing a beverage 114. Therefore, a stemmed glass is easily placed within and removed from the cup holder 100. The stemmed glass 112 rests on the floor 108 of the lower compartment while the bottom portion of the stem 118 of the glass 112 resides inside an opening 116 in the floor 106 of the upper compartment 122. The floor 106 of the upper compartment 122 also forms the ceiling 106 of the lower compartment 104. The upper compartment 122 of the cup holder 100 is cylindrical in shape while the lower compartment 104 is configured to accommodation the base 120 of a stemmed glass 112.

Figure 5:
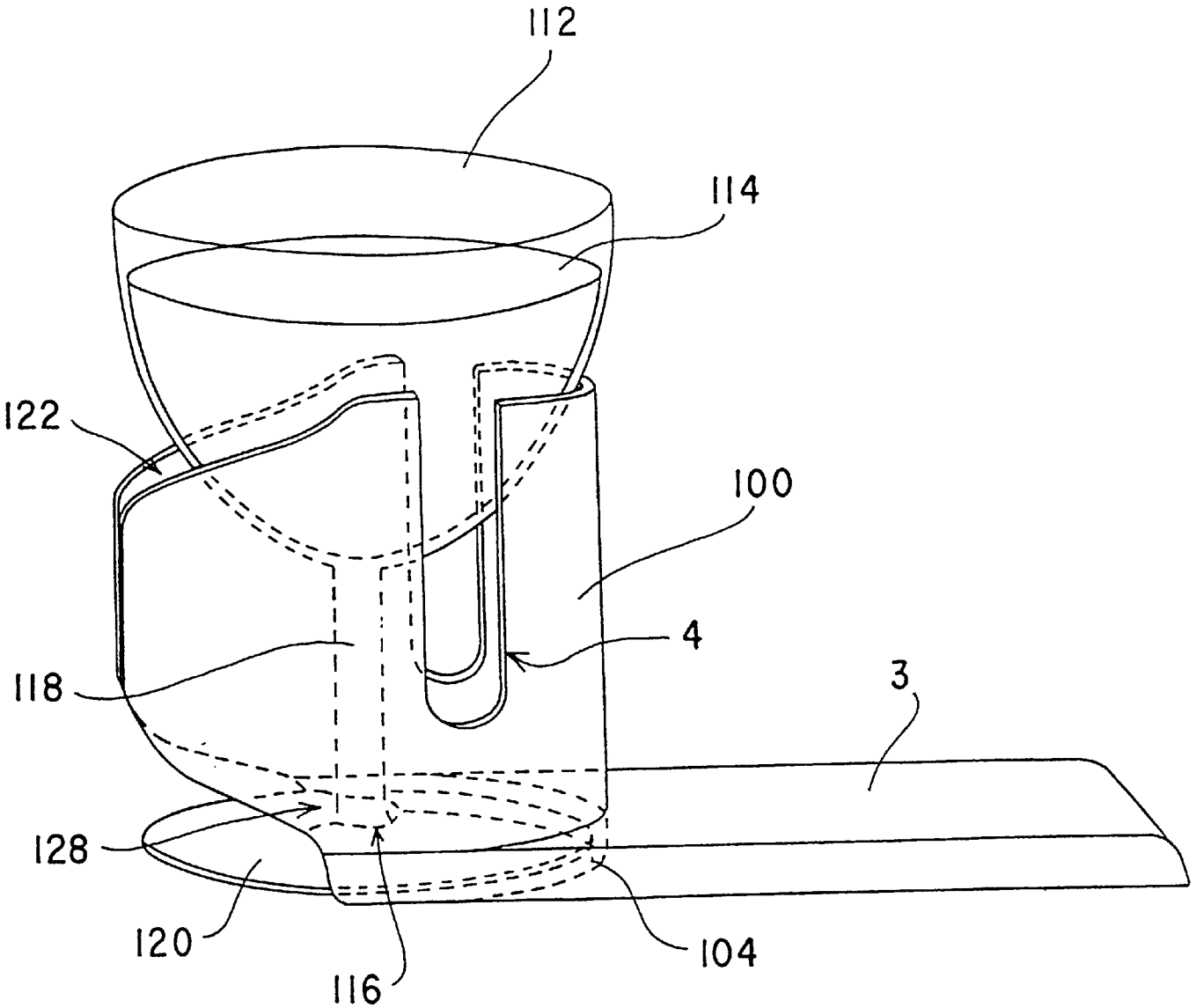
FIG. 5 is a side view of a preferred embodiment of a slotted cup holder showing the contoured configuration of the cup according to the present invention.

A side view of the second preferred embodiment of the slotted cup holder 100 is depicted in FIG. 5 which shows the novel and innovative contoured configuration of the cup holder 100. This sleek contoured design allows for easy access and removal of conventional glasses, cans, handled cups, and stemmed glasses 112. This unique design endows the slotted cup holder with a multifaceted functionality. A stemmed glass 112 resides in both the upper compartment 122 and the lower compartment 104 with the base 120 of the stemmed glass 112 resting on the floor 108 of the lower compartment 104, while a conventional glass, a can, and a handled glass or cup resides in the upper compartment 122 with the base of the beverage containers resting on the floor of the upper compartment 106. In fact, the slotted cup holder 100 of the present invention can accommodate almost any type of beverage receptacle or container of the appropriate size and/or shape. The slotted cup holder 100 shown in FIG. 5 has a "wedge style" opening 128 in the floor 106 of the upper compartment 122 for accommodating the stem 118 of a stemmed glass 112.

Figure 6A:
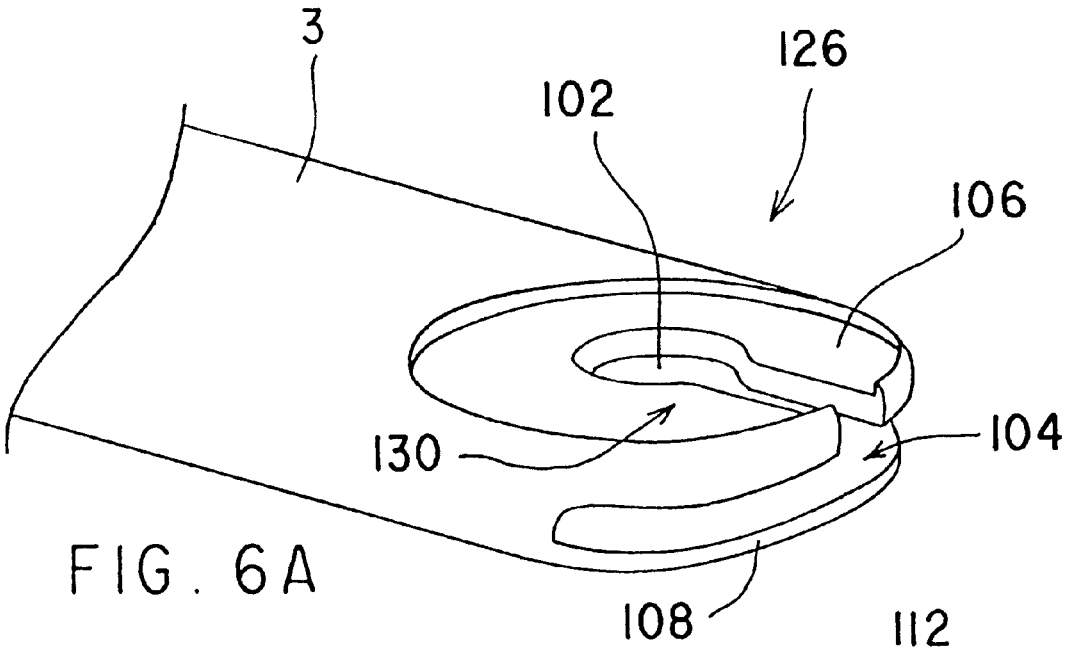
FIG. 6A is a perspective view of the lower portion of the slotted cup holder with the top portion of the cup holder removed according to the present invention.
Figure 6B:
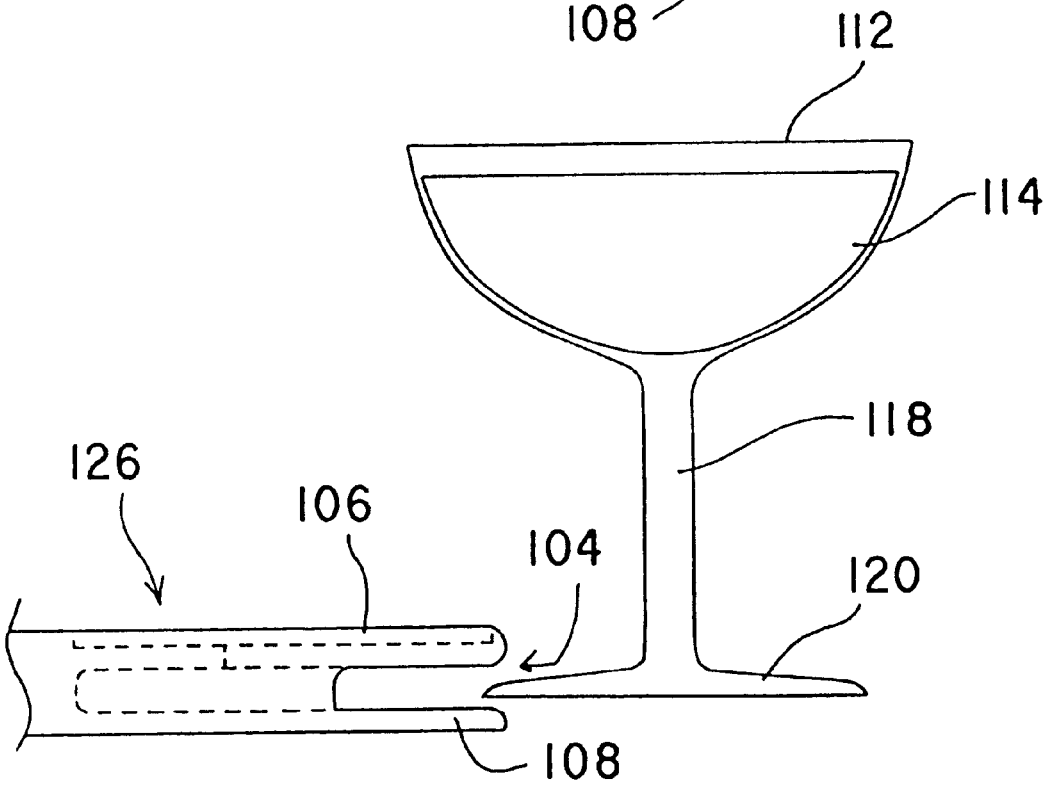
FIG. 6B is a side view of the lower portion of the cup holder with the upper portion of the cup holder removed according to the present invention.

FIGS. 6A is a perspective view of the lower portion 126 of the slotted cup holder 100 with the upper portion of the cup holder 100 removed. The slotted cup holder 100 depicted in FIG. 6A has a "slotted style" opening 130 in the floor 106 of the upper compartment 122 (lateral walls of upper compartment have been removed for clarity of illustration) for accommodating the stem 118 of a stemmed glass 112. In FIG. 6A, the structural features of the lower portion 126 of the cup holder 100 are clearly delineated. FIG. 6B is a side view of the lower portion 126 of the cup holder 100 with the upper portion removed.

Figure 7:
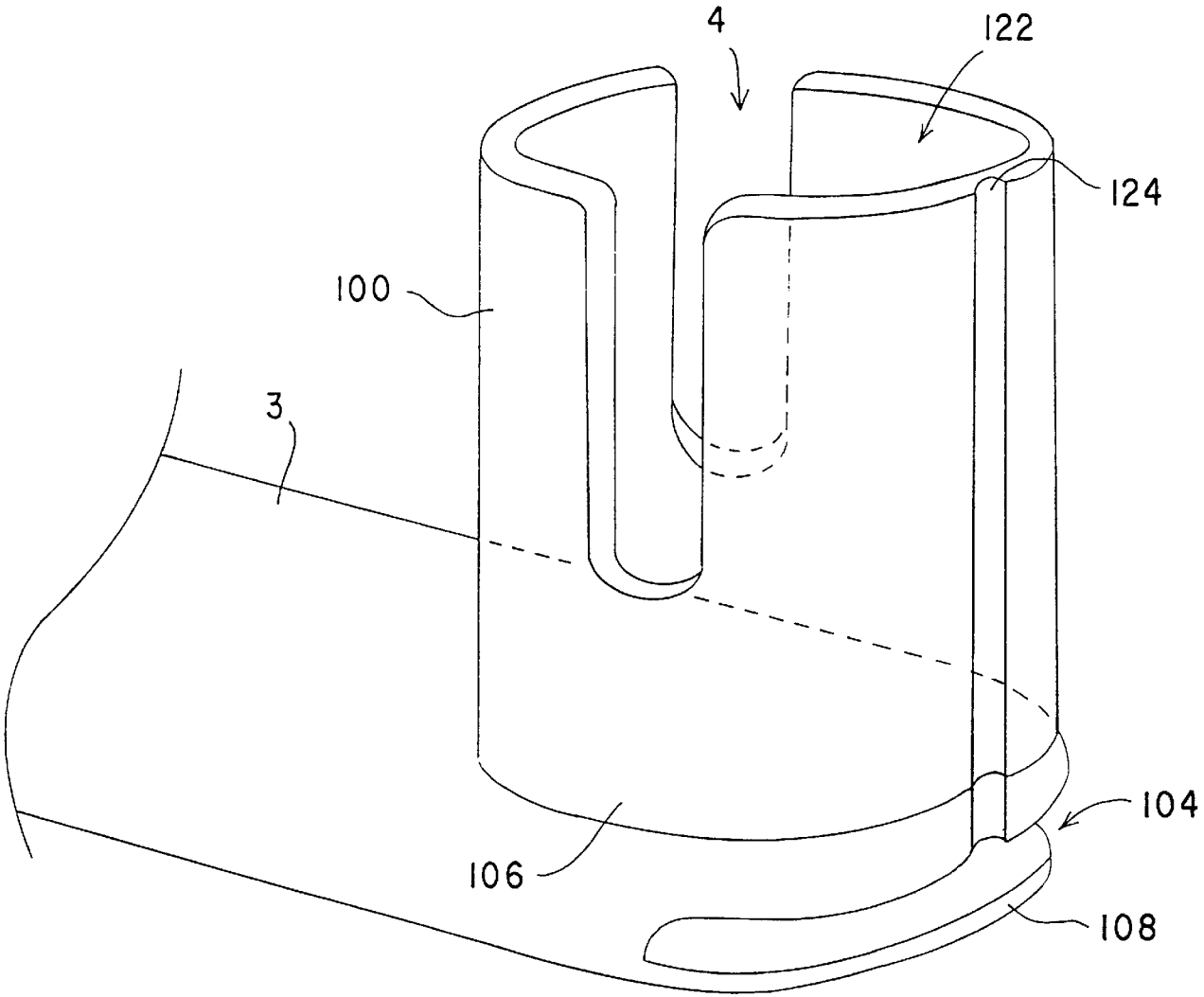
FIG. 7 is a perspective view of an alternate embodiment of the slotted cup holder showing the elongated anterior indentation according to the present invention.

FIG. 7 depicts an alternate embodiment of the slotted cup holder 100. In FIG. 7, the slotted cup holder 100 has an elongated vertically disposed anterior indentation 124 for holding the stem (11,118) of a stemmed glass (8,112) with the base (12,120) of the stemmed glass (8,112) fitting snugly into the lower compartment 104 of the cup holder 100.

In the embodiments depicted in FIGS. 5 and 6A, the upper compartment 122 and the lower compartment 104 are in fluid communication while in the embodiment depicted in FIG. 7, the upper compartment 122 and the lower compartment 104 are completely separate. However, the anterior indentation 124 shown in FIG. 7 can be used instead of the semi-circular slot 5 shown in FIG. 1 to create a cup holder 2 having a single compartment that holds both conventional glasses or handled cups and stemmed glasses 8 with the stem 12 of the stemmed glass 8 residing within the anterior indentation 124.

The present invention can be used in any setting where there are appropriately configured tables. FIG. 1 shows how the tongue 3 of the cup holder 1 resides between the table rail 13 and the table 14 thereby securing the cup holder 1 in that location. The present invention is also designed to accommodate broad spectrum of beverage container shapes, for example, handled coffee cups as well as the usual beer and soda glasses. However, the preferred embodiments of the present invention disclosed herein are intended to be illustrative only and are not intended to limit the scope of the invention.

The preferred embodiments of the present invention disclosed herein are intended to be illustrative only and are not intended to limit the scope of the invention. It should be understood by those skilled in the art that various modifications and adaptations, of the present invention as well as alternative embodiments of the present may be contemplated. It is to be understood that the present invention is not limited to the sole embodiments described above, but encompasses any and all embodiments within the scope of the following claims.

What is claimed is:

1. A slotted cup holder comprising:

a cylindrical body having an open top portion, a base, two elongated lateral slots that are disposed 90 degrees to one another, a semi-circular top anterior slot, and an oblong horizontal bottom anterior slot;

an elongated anterior indentation that extends from said semi-circular top anterior slot to said oblong horizontal bottom anterior slot; and an integrally formed elongated flat appendage extending rearwardly from the base of said cylindrical body.

2. A slotted cup holder according to claim 1, wherein:

the top portion of said elongated lateral slots is tapered.

3. A slotted cup holder according to claim 1, wherein:

the top portion of said elongated lateral slots is flared.

4. A slotted cup holder comprising:

an upper receptacle having a cylindrically configured body, said upper receptacle having two elongated lateral slots that are disposed 90 degrees to one another; and a lower receptacle having an elongated horizontally disposed cavity having an upper boundary surface and a lower boundary surface wherein said upper boundary surface supports a container placed within said cylindrically configured upper receptacle and said lower boundary surface supports a container placed within said lower receptacle;

said upper receptacle and said lower receptacle are in fluid communication;

a vertically disposed elongated anterior opening that divides the anterior portion of said cup holder into two equal halves; and an integrally formed elongated flat appendage that extends rearwardly of said lower receptacle.

5. A slotted cup holder according to claim 4, wherein:

said upper receptacle and said lower receptacle are separated by a configured partition;

wherein said configured partition contains an opening configured to receive the stem of a long stem glass.

* * * * *